US006935844B1

(12) United States Patent
Dukes et al.

(10) Patent No.: US 6,935,844 B1
(45) Date of Patent: Aug. 30, 2005

(54) GAS PRESSURE DRIVEN FLUID PUMP HAVING MAGNETIC VALVE CONTROL MECHANISM AND METHOD

(75) Inventors: Jon William Dukes, Columbia, SC (US); Rickie Anthony Pendergrass, Rock Hill, SC (US); Drew Leo Platts, Barnwell, SC (US); Jairo Luiz Soares, Columbia, SC (US)

(73) Assignee: Spirax Sarco, Inc., Blythewood, SC (US)

( * ) Notice: Subject to any disclaimer, the term of this patent is extended or adjusted under 35 U.S.C. 154(b) by 50 days.

(21) Appl. No.: 10/374,206

(22) Filed: Feb. 26, 2003

Related U.S. Application Data

(60) Provisional application No. 60/436,047, filed on Dec. 23, 2002.

(51) Int. Cl.[7] ..... F04F 1/06
(52) U.S. Cl. ..... 417/133; 137/418; 251/65
(58) Field of Search ..... 137/416, 418, 137/429; 251/65, 75; 417/131, 133

(56) References Cited

U.S. PATENT DOCUMENTS 2,893,427 A * 7/1959 Felgate ..... 251/65
3,212,751 A * 10/1965 Hassa ..... 251/65
3,485,441 A 12/1969 Eaton, Jr.
4,436,109 A 3/1984 Taylor
4,444,217 A * 4/1984 Cummings et al. ..... 137/413
4,562,855 A 1/1986 Cummings et al.
4,577,657 A * 3/1986 Alexander ..... 251/65
4,655,244 A 4/1987 Park
5,080,126 A 1/1992 De Rycke et al.
5,472,323 A 12/1995 Hirabayashi et al.
5,495,890 A 3/1996 Edwards et al.
5,533,545 A 7/1996 Robinson
5,611,672 A 3/1997 Modesitt
5,641,272 A 6/1997 Harrold
5,938,409 A 8/1999 Radle, Jr. et al.
6,027,314 A 2/2000 Breslin
6,089,258 A 7/2000 Busick et al.

FOREIGN PATENT DOCUMENTS

JP 2003-90493 * 3/2003

* cited by examiner

*Primary Examiner*—Michael Koczo, Jr.
(74) *Attorney, Agent, or Firm*—Nelson Mullins Riley & Scarborough

(57) ABSTRACT

A gas pressure driven fluid pump comprising a pump tank having a liquid inlet and a liquid outlet. A float, carried within the interior of the pump tank, is operable to move between a low level position and a high level position. A snap-acting valve control mechanism uses magnetic interaction to switch between exhaust porting and motive porting. Fluid exiting the pump tank causes the float to fall from the high level position to the low level position due to introduction of motive gas during motive porting. Exhaust porting begins when the float falls to the low level position.

13 Claims, 7 Drawing Sheets

GAS PRESSURE DRIVEN FLUID PUMP HAVING MAGNETIC VALVE CONTROL MECHANISM AND METHOD

PRIORITY CLAIM

This application claims priority to U.S. Provisional Application Ser. No. 60/436,047, filed Dec. 23, 2002, which is hereby incorporated by reference.

BACKGROUND OF THE INVENTION

The present invention relates generally to gas pressure driven fluid pumps. More particularly, the invention relates to such a pump utilizing a magnetic valve control mechanism which selectively opens and closes gas ports in a snap acting manner.

Condensate removal systems in steam piping arrangements often utilize gas pressure driven pumps that function without electrical power. As described in U.S. Pat. No. 5,938,409 to Radle (incorporated herein by reference), such a pump typically will have a tank with a liquid inlet and a liquid outlet. The liquid inlet and liquid outlet, which are located near the bottom of the tank, will be equipped with an inlet check valve and an outlet check valve to permit liquid flow only in the pumping direction. A pair of interconnected valves control a gas motive port and a gas exhaust port.

The pump operates by alternating between a liquid filling phase and a liquid discharge phase. During the liquid filling phase, the motive port is closed while the exhaust port is open. A float connected to a snap acting linkage rises with the level of liquid entering the tank. When the float reaches a high level position, the linkage snaps over to simultaneously open the motive port and close the exhaust port. As a result, the pump will switch to the liquid discharge phase.

In the liquid discharge phase, steam or other motive gas is introduced into the pump tank through the motive port. The motive gas forces liquid from the tank, thus causing the float to lower with the level of the liquid. When the float reaches a low level position, the linkage snaps over to simultaneously open the exhaust port and close the motive port. As a result, the pump will again be in the liquid filling phase.

While snap acting linkages used in gas pressure driven pumps of the prior art generally have functioned well, there exists room in the art for additional snap acting valve arrangements.

SUMMARY OF THE INVENTION

The present invention recognizes and addresses the foregoing considerations, and others, of prior art constructions and methods.

In one aspect, the invention provides a gas pressure driven fluid pump. The pump comprises a pump tank having a liquid inlet and a liquid outlet. A float is carried within the interior of the pump tank and moves between a low level position and a high level position, depending upon the fluid level within the pump tank.

A first magnet portion is operatively connected to the float and moves between a first position and a second position as the float moves between its low level position and its high level position. A second magnet portion is operatively associated with the first magnet portion.

The pump also includes a valve assembly connected to the second magnet portion, which is switchable in a snap-over fashion between exhaust porting and motive porting due to magnetic interaction between the first magnet portion and the second magnet portion.

When the first magnet portion is located in its first position, the valve assembly is positioned for exhaust porting. The valve assembly snaps over to motive porting when the first magnet portion reaches its second position. As a result, liquid will be alternatively introduced into and discharged from the pump tank.

In another aspect, the invention provides a snap-acting valve control mechanism for controlling at least one valve. The mechanism includes a first magnet portion that is movable between a first position and a second position. A second magnet portion is operatively associated with the first magnet portion.

The mechanism also includes an actuator connected to the second magnet portion such that movement of the actuator results from magnetic interaction between the first magnet portion and the second magnet portion. When the first magnet portion reaches its first position, the actuator moves the valve to an open position. The actuator moves the valve to a closed position, however, when the first magnet portion reaches its second position.

The invention also includes a method of operating a magnetic snap acting valve actuator assembly. The method comprises moving an annular magnet in a direction substantially parallel to its central axis. This movement of the annular magnet increases the magnetic force exerted on an inner magnet located at least partially within the annular magnet. Continued movement of the annular magnet will continue to increase the magnetic force on the inner magnet until the relative displacement of the two magnets results in the magnetic force snapping over to act in the opposite direction and quickly moving the inner magnet. When the inner magnet is moved, a valve is actuated in a snap over manner.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof to one of ordinary skill in the art, is set forth more particularly in the remainder of the specification, which makes reference to the accompanying drawings, in which.

Figure 1A:
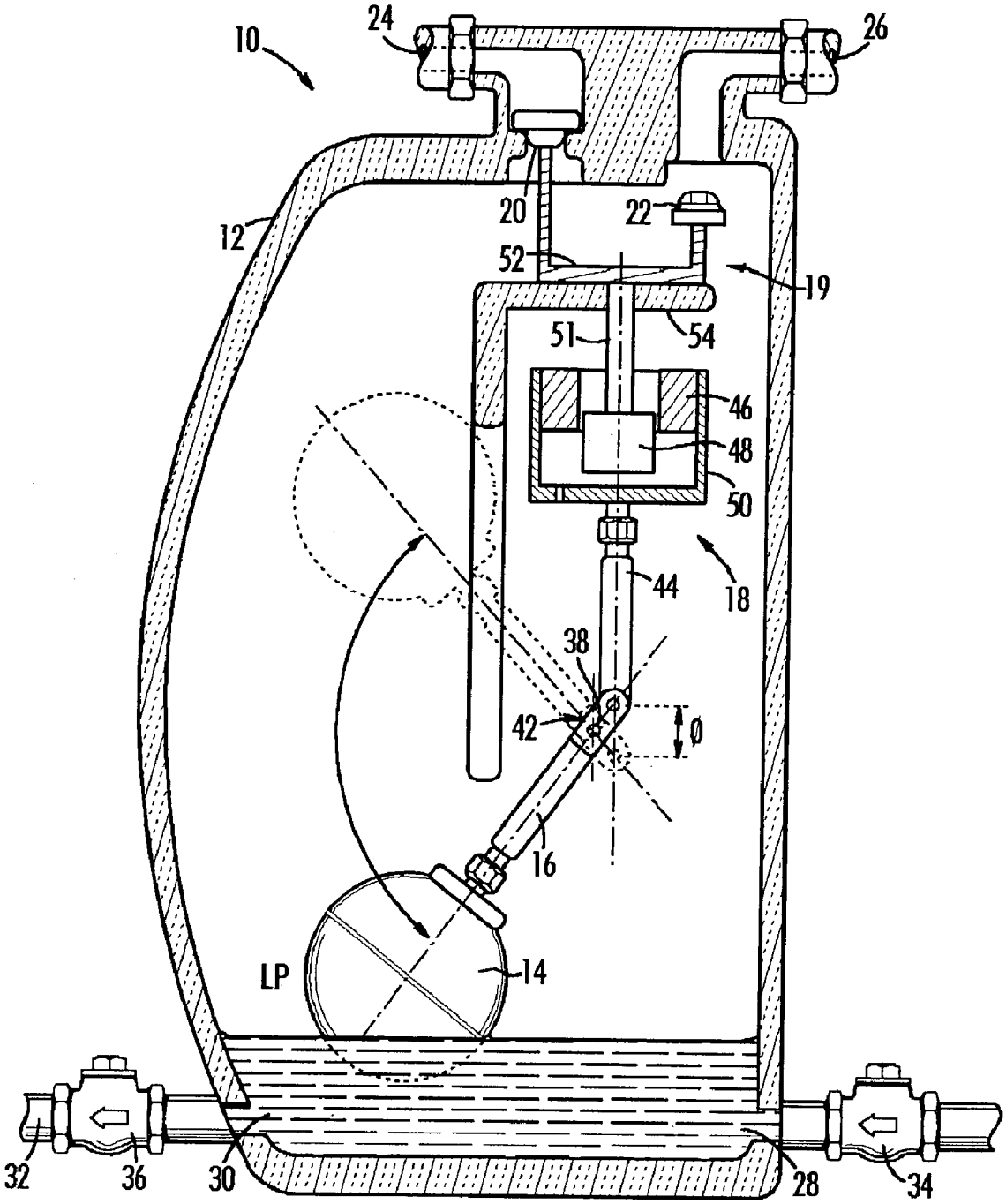
FIG. 1A is a side cross sectional view of a pressure driven pump constructed in accordance with the present invention with the float in the low level position.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention.

FIGS. 1A–1D illustrate a pressure driven pump 10 constructed in accordance with the present invention. As shown, pump 10 has a tank 12 defining an interior in which a float 14 is located. Float 14 is attached to the end of a float arm 16, which is operatively connected to a valve control mechanism 18. Valve control mechanism 18, in turn, controls the operation of a valve assembly 19 including a motive valve 20 and an exhaust valve 22.

Valves 20 and 22, respectively, function to introduce motive gas into and exhaust gas out of the interior of tank 12 based on the position of float 14. Toward this end, a motive pipe 24 is connected between motive valve 20 and a source of motive gas, such as a source of steam. Similarly, a balance pipe 26 is connected between exhaust valve 22 and a suitable sink to which gas inside of tank 12 can be exhausted. In some cases, for example, balance pipe 26 can terminate such that the gas will simply exhaust to the ambient atmosphere.

As shown, tank 12 defines a liquid inlet 28 through which the liquid to be pumped is introduced. Tank 12 further defines a liquid outlet 30 through which the liquid passes when pumped into return line 32. Respective check valves 34 and 36 are provided at liquid inlet 28 and liquid outlet 30 so that the liquid flows in only the desired direction.

When tank 12 is emptied, float 14 will fall to the low level position LP shown in FIG. 1A. Upon reaching position LP, mechanism 18 simultaneously switches motive valve 20 and exhaust valve 22 in a snap over manner from motive porting to exhaust porting. During exhaust porting, exhaust valve 22 is open to allow fluid communication between the interior of tank 12 and balance pipe 26; motive valve 20, however, is closed to block fluid communication between motive pipe 24 and tank 12. It should be appreciated by one of ordinary skill in the art that various types of valves could be used for motive valve 20 and exhaust valve 22.

Figure 1B:
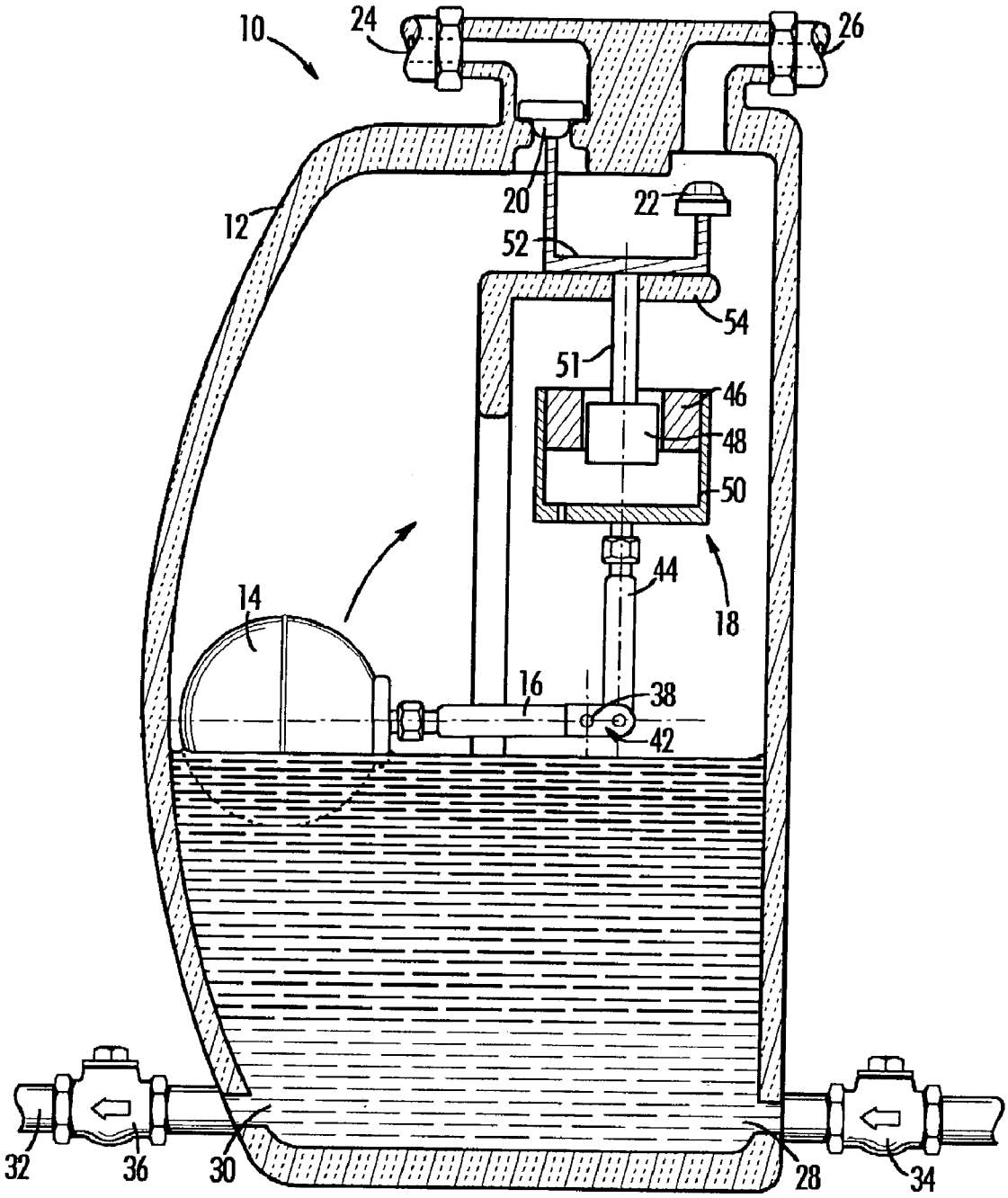
FIG. 1B is a side cross sectional view of the pressure driven pump of FIG. 1A with the float moving toward, but not yet reaching the high level position.

At the beginning of the liquid filling phase, liquid will begin flowing into tank 12 when the pressure is sufficient to overcome the pressure drop across check valve 34. If the pressure of the liquid is high enough, it will continue through check valve 36 and into return line 32. When the back pressure in return line 32 exceeds the pressure in the interior of tank 12, however, the liquid will begin to fill tank 12. As the level of the liquid rises, so does float 14. As seen in FIG. 1B, however, the positions of motive valve 20 and exhaust valve 22 do not change when float 14 is rising.

Figure 1C:
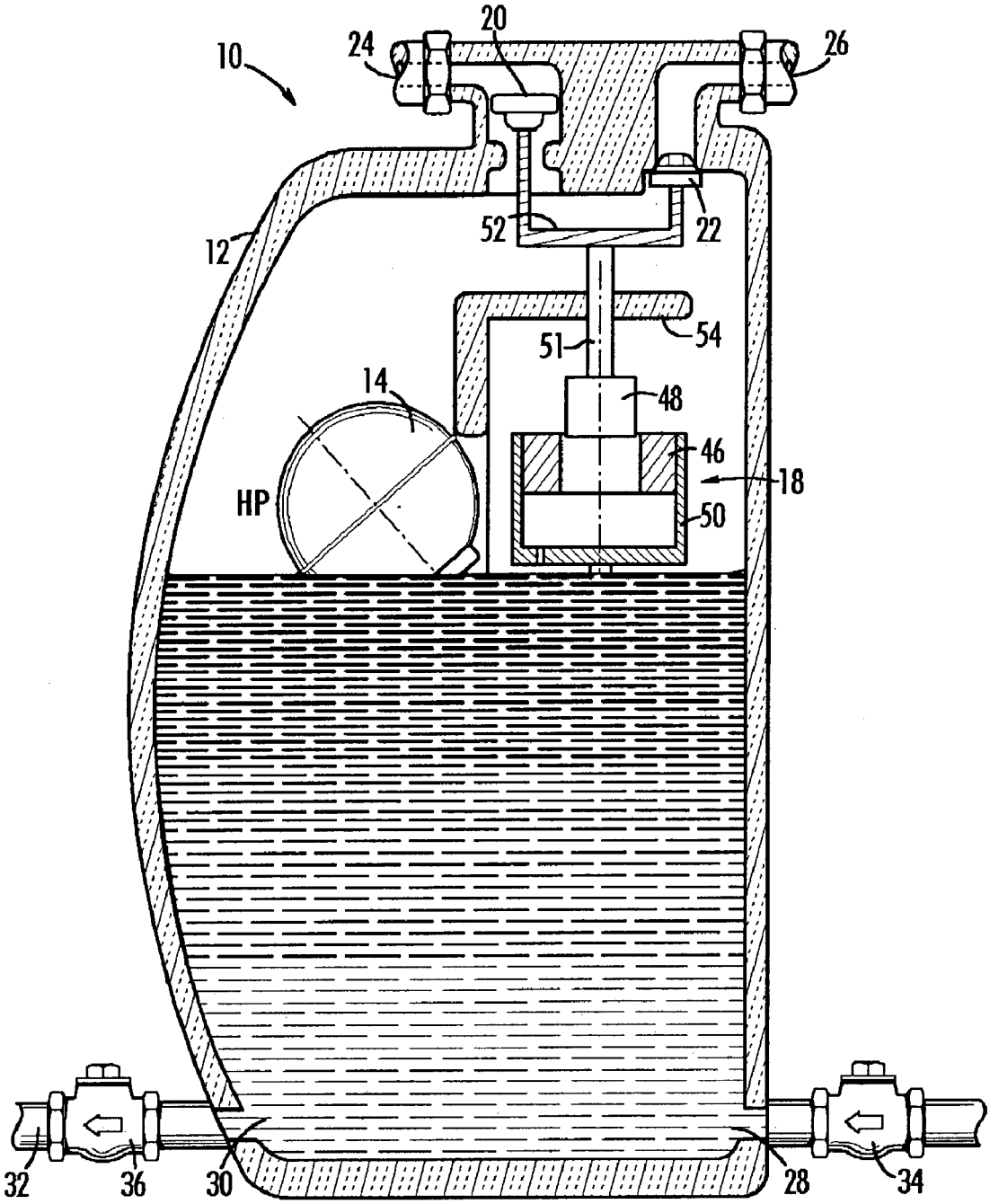
FIG. 1C is a side cross sectional view of the pressure driven pump of FIG. 1A with the float in the high level position.
Figure 1D:
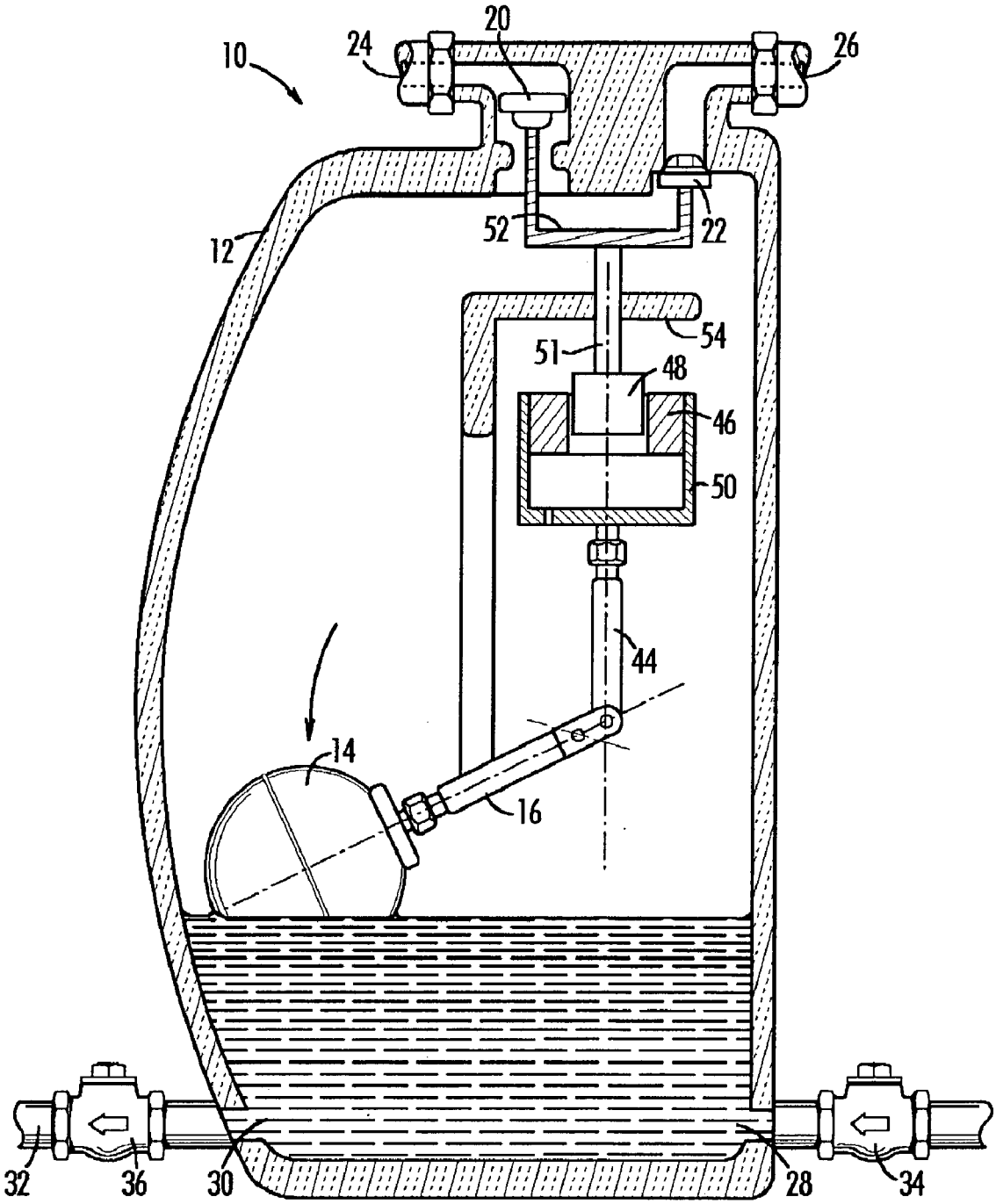
FIG. 1D is a side cross sectional view of the pressure driven pump of FIG. 1A with the float moving toward, but not yet reaching the low level position.

When float 14 reaches position HP, however, as shown in FIG. 1C, mechanism 18 simultaneously switches motive valve 20 and exhaust valve 22 in a snap over manner from exhaust porting to motive porting. During motive porting, motive valve 20 allows fluid communication between the motive pipe 24 and the interior of tank 12. Motive gas thus introduced into tank 12 will force the liquid through liquid outlet 30 and into return line 32. In contrast, exhaust valve 22 is closed during motive porting as shown. Float 14 drops along with the level of the liquid. As shown in FIG. 1D, however, the positioning of motive valve 20 and exhaust valve 22 remains the same until float 14 reaches position LP. When float 14 eventually falls to position LP, the pumping cycle will begin again.

Figure 2A:
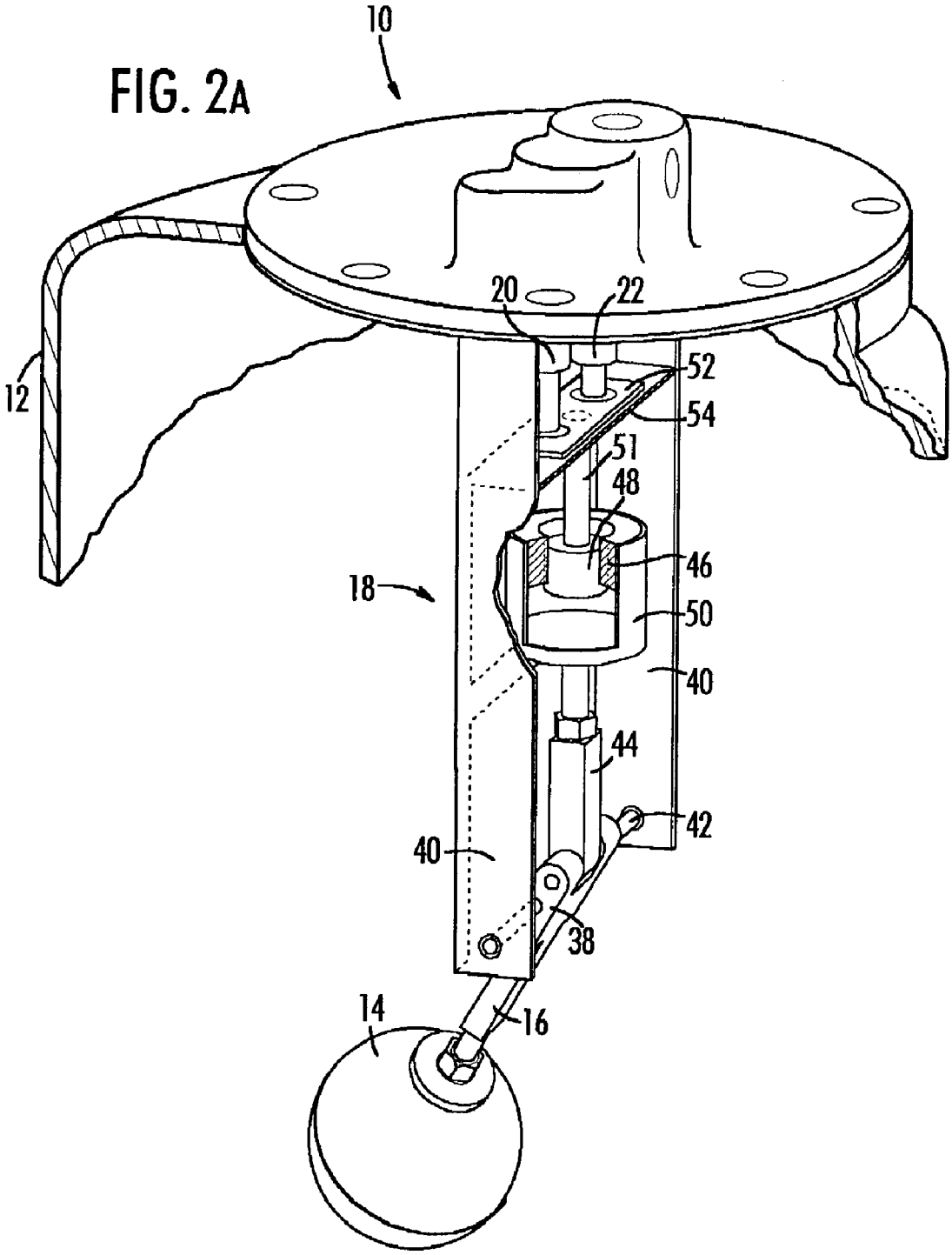
FIG. 2A is a detailed perspective view, partially in section, of a valve control mechanism for a pressure driven pump constructed in accordance with the present invention with the float in the low level position.
Figure 2B:
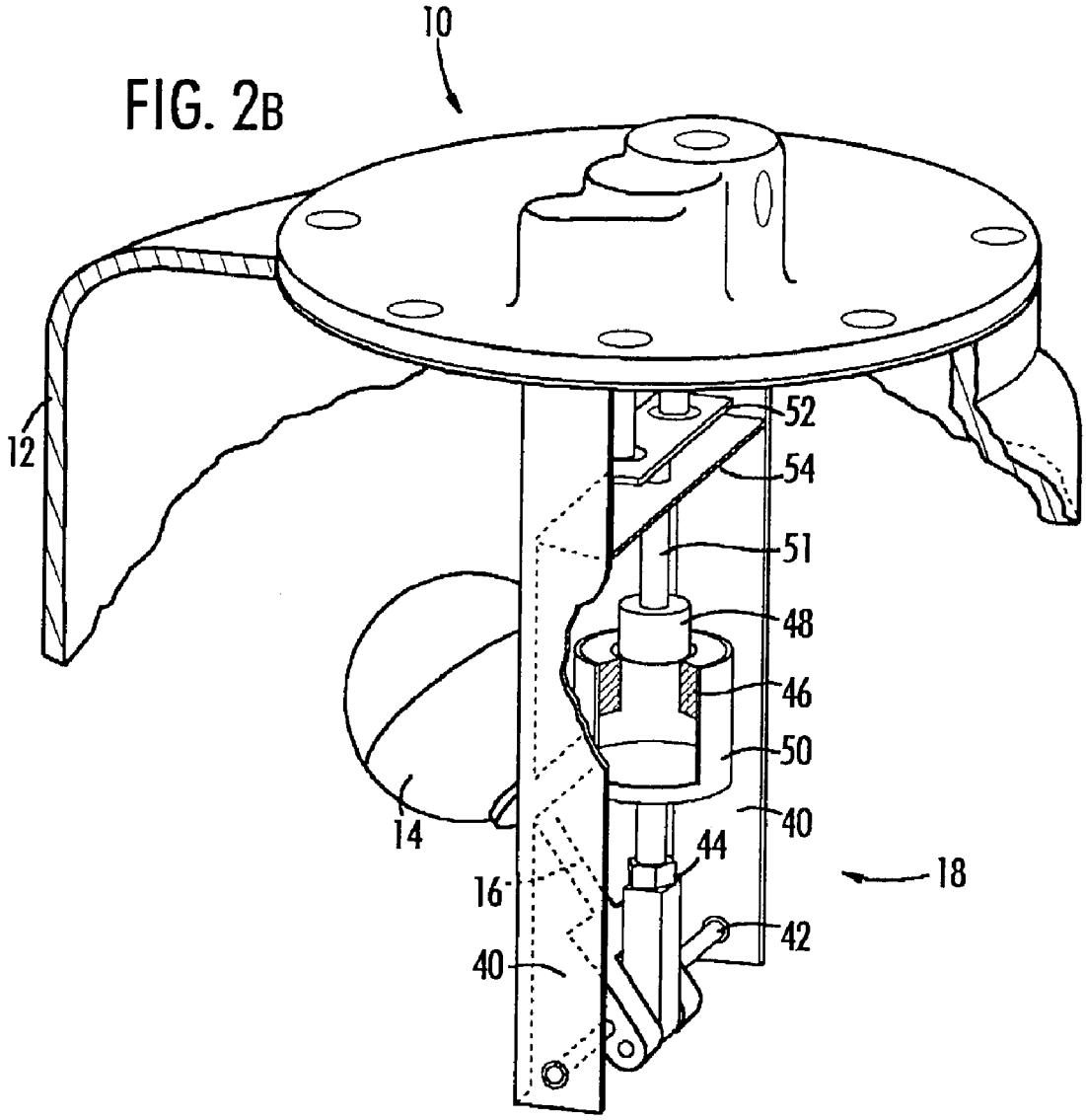
FIG. 2B is a view similar to FIG. 2A but with the float in the high level position.

The construction of valve control mechanism 18 will now be described with reference to FIGS. 2A and 2B. Mechanism 18 contains a fulcrum 38 about which float arm 16 is pivotally connected. One of ordinary skill in the art should recognize that there are numerous devices that could be used to pivotally connect float arm 16 to mechanism 18. As shown, for example, mechanism 18 could include a pair of depending rails 40 with a pin 42 extending therebetween. Pin 42 extends through float arm 16 so as to pivot at this location. Alternatively, float arm 16 could pivot from a shaft transversely attached to the interior of tank or using another pivotal connection.

Float arm 16 is also pivotally connected to a push rod 44. As shown, the pivot point between float arm 16 and push rod 44 is offset from fulcrum 38 by a predetermined lateral distance. Thus, rotation of float arm 16 causes vertical movement of push rod 44 along its longitudinal axis. The movement of float 14 from position LP toward position HP moves push rod 44 in a first direction along its longitudinal axis (downward as shown in FIGS. 1A–1B). As float 14 moves from position HP to position LP, however, push rod 44 moves in an opposite direction along its longitudinal axis (upward as shown in FIGS. 1C–1D).

Mechanism 18 includes a pair of repelling magnets that facilitate snap-over action: an outer magnet 46 and an inner magnet 48. In some embodiments, movement of push rod 44 along its longitudinal axis causes movement of outer magnet 46 along a parallel axis. Upon reaching an extreme position, outer magnet 46 causes movement of inner magnet 48 along an approximately parallel axis. It will be appreciated that the use of repelling magnets reduces the number of moving parts and linkages relative to spring-type mechanisms. Moreover, the number of friction points is reduced. Thus the use of repelling magnets reduces the potential for failure. Both inner magnet 48 and outer magnet 46 could be formed from various suitable materials, such as neodymium iron boron or samarium cobalt. Furthermore, it should be appreciated that attractive magnets may also be used.

A retaining structure 50 connected to push rod 44 holds outer magnet 46. As can be seen, support structure 50 has a generally cup-like configuration in this embodiment in which magnet 46 is inserted. As one skilled in the art will appreciate, structure 50 and push rod 44 can be constructed as a unitary member or can be two pieces that are connected together. It should also be appreciated that structure 50 is preferably formed from a nonmagnetic material, such as aluminum. Outer magnet 46 moves linearly with the movement of push rod 44, which is controlled by the movement of float 14. Thus, outer magnet 46 reaches its extreme positions when float 14 does the same.

Inner magnet 48 is attached to an actuator plate 52 via shaft 51, such that movement of inner magnet 48 also moves actuator plate 52. One of ordinary skill in the art should recognize that inner magnet 48 and actuator plate 52 can be constructed as a unitary member or can be two pieces that are connected together. It should also be appreciated that inner magnet 48 could be held within a sheath formed from a nonferrous material, such as copper, aluminum or suitable polymeric materials. The sheath will protect and guide the inner magnet as it may rub against the inner diameter of the outer magnet.

As shown, actuator plate 52 is in communication with both motive valve 20 and exhaust valve 22. Thus, movement of actuator plate 52 controls the porting of motive valve 20 and exhaust valve 22. As seen in FIGS. 1A and 1B, motive valve 20 is closed and exhaust valve 22 is open when actuator plate 52 rests on stop 54. With actuator plate 52 in an elevated position, however, motive valve 20 is open and exhaust valve 22 is closed, as seen in FIGS. 1C and 1D. Stop 54 limits downward movement of actuator plate 52 while upward movement is limited by exhaust valve 22 in this embodiment. One skilled in the art should recognize that multiple methods could be used for communication between the valves and actuator plate 52.

As outer magnet 46 moves through its range of motion, based upon the position of float 14, the relative magnetic force imparted upon inner magnet 48 changes. When outer magnet 46 reaches either extreme position (corresponding with either position HP or position LP of float 14), the magnetic interaction between outer magnet 46 and inner magnet 48 is sufficient to cause repelling movement of inner magnet 48.

When float 14 reaches position LP, the magnetic interaction between outer magnet 46 and inner magnet 48 imparts a sufficient downward force on inner magnet 48 to move inner magnet 48 in a snap over manner to its exhaust position (actuator plate 52 resting on stop 54). Thus, motive valve 20 is closed and exhaust valve 22 is open. When float 14 reaches position HP, the magnetic interaction between outer magnet 46 and inner magnet 48 imparts a sufficient upward force on inner magnet 48 to move inner magnet 48 in a snap over manner to its motive position (actuator plate 52 in an elevated position). Thus, motive valve 20 is open and exhaust valve 22 is closed.

Magnets 46 and 48 could be configured numerous ways to produce sufficient magnetic interaction to cause snap over movement. As shown, for example, an annular outer magnet 46 could be used to provide a surrounding magnetic force to move a cylindrical inner magnet 48. With this configuration, cylindrical inner magnet 48 is received within the inner diameter of annular outer magnet 46.

In some embodiments, magnets 46 and 48 could be configured as planar magnets. For example, magnet 48 could be configured as a single planar magnet with one or more adjacent planar magnets. Moreover, a guide (not shown) could be used to reduce lateral movement of inner magnet 48. Particularly with a guide, a single planar magnet could be used to impart movement of inner magnet 48. In addition, one skilled in the art will appreciate that the configuration of structure 50 may change based upon the configuration of outer magnet 46. In other embodiments, valve control mechanism 18 could be mounted to a vertical cover flange (not shown) using mounts on the side of the pump tank.

Figure 3A:
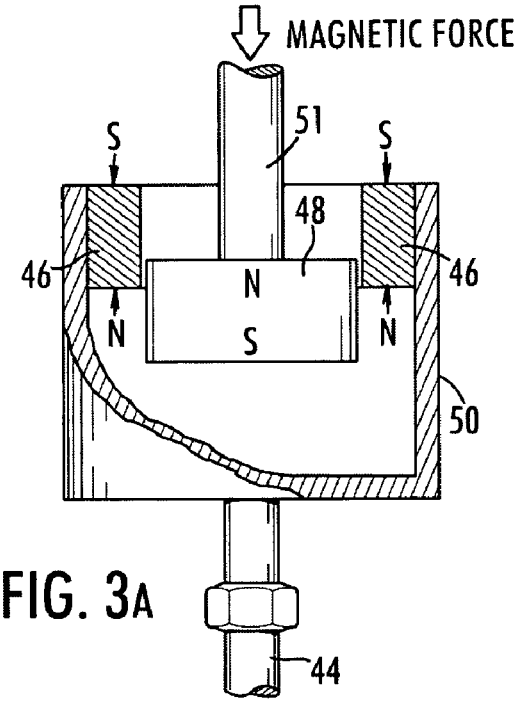
FIG. 3A is a detailed side cross-sectional view of the magnetic interaction between the inner magnet and outer magnet in accordance with the present invention with the float in the low level position.

The interaction between outer magnet 46 and inner magnet 48 during a pumping cycle will now be discussed. When tank 12 is emptied, float 14 will fall to position LP. The movement of float arm 16 causes upward movement of push rod 44 and outer magnet 46. Upon reaching position LP, the position of outer magnet 46 with respect to inner magnet 48 causes sufficient magnetic interaction to move inner magnet 48 in a snap over position to its exhaust position as shown in FIGS. 1A and 3A. In the exhaust position, actuator plate 52 rests on stop 54, thereby placing motive valve 20 in a closed position and exhaust valve 22 in an open position. Exhaust valve 22 thus allows fluid communication between the interior of tank 12 and balance pipe 26 while motive valve 20 prevents fluid communication between motive pipe 24 and tank 12.

Figure 3B:
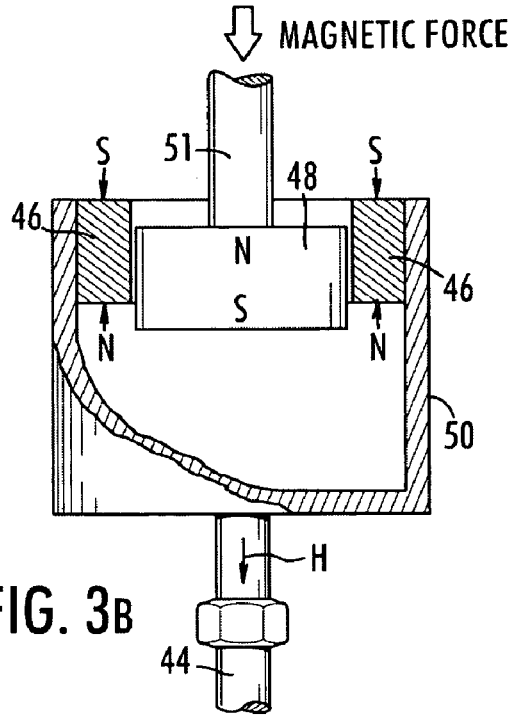
FIG. 3B is a view similar to FIG. 3A but showing magnet positions with the float moving toward, but not yet reaching the high level position.

As liquid begins flowing into tank 12, float 14 rises. The movement of float arm 16 causes downward movement of push rod 44 and outer magnet 46 as indicated by arrow H in FIG. 3B. As seen in FIGS. 1B and 3B, however, the positioning of inner magnet 48 remains the same until outer magnet 46 reaches a position corresponding with position HP of float 14. Thus, the position of motive valve 20 and exhaust valve 22 also remains the same.

Figure 3C:
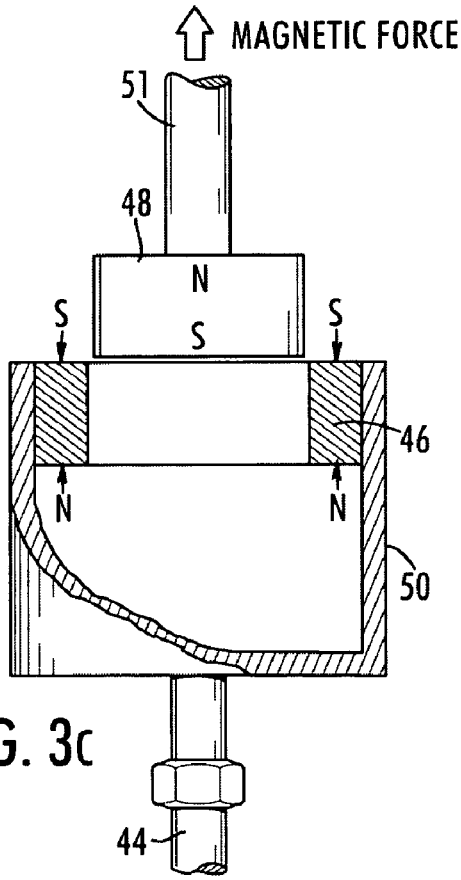
FIG. 3C is a view similar to FIG. 3A but showing magnet positions in the high level position.
Figure 3D:
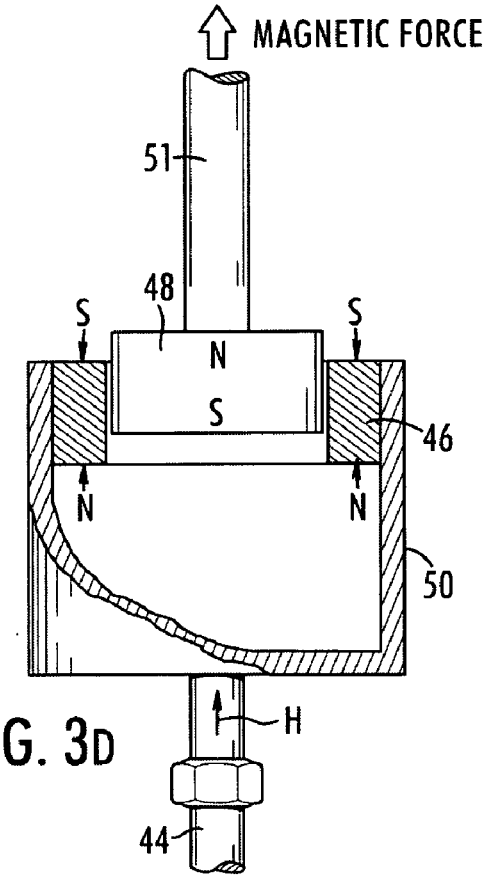
FIG. 3D is a view similar to FIG. 3A but showing magnet positions with the float moving toward, but not yet reaching the low level position.

When float 14 reaches position HP, the position of outer magnet 46 with respect to inner magnet 48 causes sufficient magnetic interaction to move inner magnet 48 in a snap over manner to its motive position as shown in FIGS. 1C and 3C. In the motive position, actuator plate 52 is elevated, thereby placing motive valve 20 in an open position and exhaust valve 22 in a closed position. Motive valve 20 thus allows fluid communication between the interior of tank 12 and motive pipe 24 while exhaust valve 22 prevents fluid communication between balance pipe 26 and tank 12. When float 14 eventually falls to position LP, the pumping cycle will begin again.

One skilled in the art will appreciate that the valve control mechanism of the present invention could be utilized in various applications other than a gas pressure driven pump as described above. In such applications, the mechanism could be operated by various devices and mechanisms other than a float (e.g., by hand, electric, pneumatic, etc.). Moreover, it is often not necessary or desirable to attach physically the stem of valve 20 to plate 52. In such embodiments, plate 52 can push the stem up when plate 52 rises from stop 54. The pressure inside of motive pipe 24 will close valve 20 when plate 52 is resting on stop 54.

While preferred embodiments of the invention have been shown and described, modifications and variations may be made thereto by those of ordinary skill in the art without departing from the spirit and scope of the present invention. It should also be understood that aspects of the various embodiments may be interchanged both in whole or in part. Furthermore, those of ordinary skill in the art will appreciate that the foregoing description is by way of example only, and is not intended to be limitative of the invention as further described in the appended claims.

What is claimed is:

1. A gas pressure driven fluid pump, said pump comprising:

a pump tank having a liquid inlet and a liquid outlet;

a float carried within the interior of said pump tank, said float being operable to move between a low level position and a high level position;

a first magnet portion operatively connected to said float, said first magnet portion moving between a first position and a second position as said float moves between said low level position and said high level position;

a second magnet portion operatively associated with said first magnet portion so as to move along an approximately parallel axis;

a valve assembly connected to said second magnet portion, said valve assembly being switchable between exhaust porting and motive porting in a snap over fashion due to magnetic interaction between said first magnet portion and said second magnet portion; and said valve assembly moving to said exhaust porting when said first magnet portion reaches said first position and to motive porting when said first magnet portion reaches said second position such that liquid will be alternately introduced into and discharged from said pump tank.

2. The pump as recited in claim 1, wherein said first magnet portion and said second magnet portion move along a common axis.

3. The pump as recited in claim 1, wherein said first magnet portion has an annular configuration.

4. The pump as recited in claim 3, wherein at least a portion of said second magnet portion has a cylindrical shape capable of passing into said first magnet portion.

5. The pump as recited in claim 1, wherein said valve assembly includes a motive valve connected between said pump tank and a source of motive gas and an exhaust valve connected between said tank and a sink.

6. A gas pressure driven fluid pump, said pump comprising:

a pump tank having a liquid inlet and a liquid outlet;

a float carried within the interior of said pump tank, said float being operable to move between a low level position and a high level position;

a first magnet portion operatively connected to said float, said first magnet portion moving between a first position and a second position as said float moves between said low level position and said high level position;

wherein said float has a float arm pivotally connected to said pump tank about a fulcrum and said first magnet portion has a push rod, said float arm being pivotally connected to said push rod at a location offset from said fulcrum;

a second magnet portion operatively associated with said first magnet portion;

a valve assembly connected to said second magnet portion, said valve assembly being switchable between exhaust porting and motive porting in a snap over fashion due to magnetic interaction between said first magnet portion and said second magnet portion; and said valve assembly moving to said exhaust porting when said first magnet portion reaches said first position and to motive porting when said first magnet portion reaches said second position such that liquid will be alternately introduced into and discharged from said pump tank.

7. The pump as recited in claim 6, wherein pivotal movement of said float arm causes movement of said push rod along its longitudinal axis.

8. The pump as recited in claim 6, wherein movement of said float toward said low level position causes movement of said push rod in a first direction and movement of said float toward said high level position causes movement of said push rod in a second, opposite position.

9. The pump as recited in claim 8, wherein said push rod moves along its longitudinal axis.

10. The pump as recited in claim 6, wherein said valve assembly includes a motive valve connected between said pump tank and a source of motive gas and an exhaust valve connected between said tank and a sink.

11. A gas pressure driven fluid pump, said pump comprising:

a pump tank having a liquid inlet and a liquid outlet;

a float carried within the interior of said pump tank, said float being operable to move between a low level position and a high level position;

a first magnet portion operatively connected to said float, said first magnet portion moving between a first position and a second position as said float moves between said low level position and said high level position;

a second magnet portion operatively associated with said first magnet portion;

a valve assembly connected to said second magnet portion, said valve assembly being switchable between exhaust porting and motive porting in a snap over fashion due to magnetic interaction between said first magnet portion and said second magnet portion;

said valve assembly moving to said exhaust porting when said first magnet portion reaches said first position and to motive porting when said first magnet portion reaches said second position such that liquid will be alternately introduced into and discharged from said pump tank;

wherein said valve assembly includes an actuator for switching between said exhaust porting and said motive porting, movement of said actuator being limited by a stop.

12. The pump as recited in claim 11, wherein said actuator is configured as a plate.

13. The pump as recited in claim 11, wherein said valve assembly includes a motive valve connected between said pump tank and a source of motive gas and an exhaust valve connected between said tank and a sink, both said motive valve and said exhaust valve being operatively connected to said actuator such that one will be open while the other is closed.

* * * * *